US008278836B2

(12) United States Patent
Wilken

(10) Patent No.: US 8,278,836 B2
(45) Date of Patent: Oct. 2, 2012

(54) EVALUATION DEVICE FOR THE IGNITION ENERGY OF A DISCHARGE LAMP

(75) Inventor: Ludger Wilken, Berlin (DE)

(73) Assignee: OSRAM AG, Munich (DE)

( * ) Notice: Subject to any disclaimer, the term of this patent is extended or adjusted under 35 U.S.C. 154(b) by 347 days.

(21) Appl. No.: 12/529,343

(22) PCT Filed: Feb. 14, 2008

(86) PCT No.: PCT/EP2008/051773

§ 371 (c)(1),
(2), (4) Date: Sep. 1, 2009

(87) PCT Pub. No.: WO2008/104461

PCT Pub. Date: Sep. 4, 2008

(65) Prior Publication Data

US 2010/0097011 A1 Apr. 22, 2010

(30) Foreign Application Priority Data

Mar. 1, 2007 (DE) ..... 20 2007 003 032 U

(51) Int. Cl.
*H05B 37/02* (2006.01)

(52) U.S. Cl. ..... 315/291; 315/307; 315/209 R

(58) Field of Classification Search ..... 315/209 R, 315/224, DIG. 5, DIG. 7, 219, 291, 307, 315/308, 223
See application file for complete search history.

(56) References Cited

U.S. PATENT DOCUMENTS

| | | | | |
|---|---|---|---|---|
| 5,485,061 | A * | 1/1996 | Ukita et al. | 315/307 |
| 5,811,940 | A | 9/1998 | Nutzel | |
| 6,127,789 | A | 10/2000 | Ishizuka et al. | |
| 6,329,762 | B1 | 12/2001 | Goh | |
| 6,624,600 | B1 * | 9/2003 | Henze | 315/291 |
| 7,245,086 | B2 | 7/2007 | Mitze | |
| 7,425,802 | B2 * | 9/2008 | Kumagai et al. | 315/291 |
| 2006/0049774 | A1 | 3/2006 | Ichikawa et al. | |
| 2006/0226131 | A1 * | 10/2006 | Stava et al. | 219/130.33 |
| 2008/0174252 | A1 | 7/2008 | Mertens et al. | |

FOREIGN PATENT DOCUMENTS

| | | | |
|---|---|---|---|
| DE | 4421736 | C2 | 1/1996 |
| DE | 19819510 | B4 | 11/1998 |
| DE | 102004045834 | A1 | 3/2006 |
| DE | 102005041836 | A1 | 3/2006 |
| DE | 102004051536 | A1 | 5/2006 |
| GB | 2352342 | B | 9/2003 |
| JP | 7220887 | A | 8/1995 |
| JP | 200593138 | A | 4/2005 |

OTHER PUBLICATIONS

International Search Report of PCT/EP2008/051773.
English abstract of JP 7-220887 A.
English abstract of 2005-93138 A.

* cited by examiner

*Primary Examiner* — James H Cho

(57) ABSTRACT

An evaluation device for measuring the ignition energy of a discharge lamp that is ignited by means of a superposed ignition unit, with the aid of a measuring signal that is proportional to the voltage across the discharge, and a measuring signal that is proportional to the current flowing through the lamp, is provided. The evaluation device is configured such that the energy injected into a discharge lamp during a high voltage pulse is suitably evaluated by means of a combination of an analog circuit and a digital circuit.

11 Claims, 5 Drawing Sheets

EVALUATION DEVICE FOR THE IGNITION ENERGY OF A DISCHARGE LAMP

RELATED APPLICATIONS

The present application is a national stage entry according to 35 U.S.C. §371 of PCT application No.: PCT/EP2008/051773 filed on Feb. 14, 2008, which claims priority from German application No.: 20 2007 003 032.0 filed on Mar. 1, 2007.

TECHNICAL FIELD

The invention relates to a device for evaluating the ignition energy of a discharge lamp from a signal that is proportional to the voltage across the discharge lamp, and from a signal that is proportional to the current that flows through the discharge lamp during the ignition process.

BACKGROUND

Connected to discharge lamps, in particular high pressure discharge lamps, for the purpose of ignition is an ignition unit that produces one or a sequence of high voltage pulses in order to ignite the discharge lamp. The high voltage pulses must have a certain minimum ignition voltage $U_z$ for successful ignition.

A high voltage probe and an oscilloscope are normally used to measure the high voltage pulses. FIG. 1 shows the time dependent voltage $U_L(t)$ generated at a 400 W sodium vapor high pressure lamp having a first ignition unit. The ignition voltage $U_Z$ is the maximum value of the voltage ($U_Z$=3.55 kV). FIG. 2*a* illustrates the current profile and the voltage profile of the discharge lamp, and the accumulated energy introduced in a long time period. The time-dependent voltage $U_L(t)$ and the evaluated ignition voltage $U_Z$ ($U_Z$=3.96 kV) are shown in FIG. 2*b* for a second ignition unit. The ignition voltage can also be measured with the aid of a peak voltage detector in a simple and cost effective way. A peak voltage detector for the evaluation of the positive maximum value of the voltage, is shown in FIG. 3. An analog-to-digital converter is used for the measurement acquisition. If the peak values of each pulse are to be measured for repeated pulses, it is therefore necessary to discharge the capacitor again between the individual pulses, and this can be done, for example, by a resistor of high resistance. The measurement acquisition system must additionally have a sufficiently high acquisition rate. It is possible to use the signals of the peak voltage detector for the purpose of controlling an ignition device.

The energy that is coupled into the discharge during the voltage collapse can be used as second measured variable in order to describe the ignition. To this end, a signal proportional to the current is measured with the aid of the oscilloscope together with the voltage. Likewise plotted in FIG. 1 and FIGS. 2*a* and *b* is the current $I_L(t)$ that flows through the lamp and for which the displacement current has been compensated. The power $$P_L(t)=U_L(t)I_L(t) \tag{1}$$

is calculated as the product of the lamp voltage $U_L(t)$ and current $I_L(t)$.

The time dependent energy is then calculated by integrating the power PL(t) for the time t:

$$E(t) = \int_0^{t_p} PL(t')dt' \tag{2}$$

Also plotted in FIG. 1 and FIGS. 2 *a, b* are the power $P_L(t)$ and the calculated time dependent energy E(t). It is to be seen that the energy E(t) remains at a constant value after the voltage collapse and when the current has returned to zero. Since, as a rule, the high voltage pulses decay within a specific time, the energy that is coupled in during this time becomes the ignition energy $E_z$.

SUMMARY

Various embodiments provide a cost effective measurement system for evaluating the ignition energy of any desired discharge lamps. Various embodiments of this evaluation device may be suited to the possibility of being integrated in electronic ballasts or in ignition units. Various embodiments provide a device that meets these requirements.

The device includes a voltage measurement circuit, a current measurement circuit and an evaluation circuit. The current signal and the voltage signal may be multiplied together in the evaluation circuit, and the resulting power signal may then be integrated in order to obtain a measure of the ignition energy. This voltage, which represents the ignition energy, may be measured by a fast analog-to-digital converter.

BRIEF DESCRIPTION OF THE DRAWINGS

Further advantages, features and details of the invention emerge with the aid of the following description of exemplary embodiments and of the drawings, in which.

DETAILED DESCRIPTION

Figure 1:
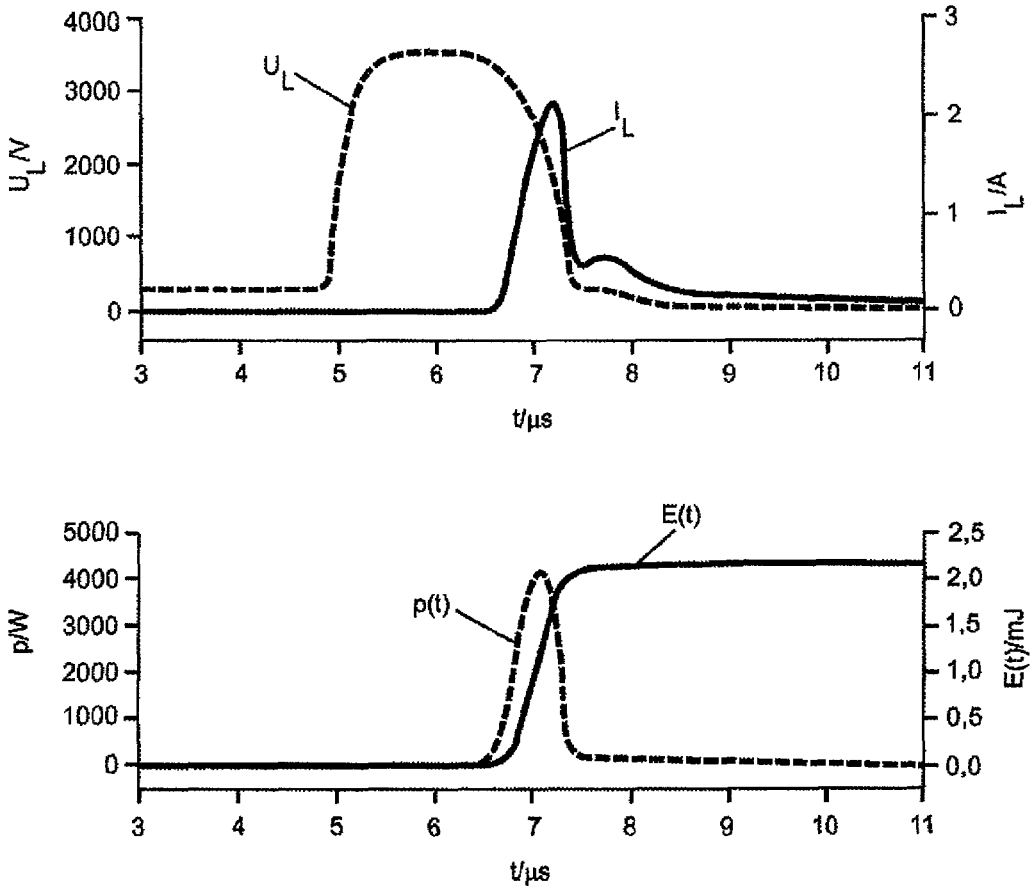
FIG. 1 shows the voltage and current and the evaluated power and energy of a high voltage pulse for igniting a discharge lamp, with a high time resolution.
Figure 2A:
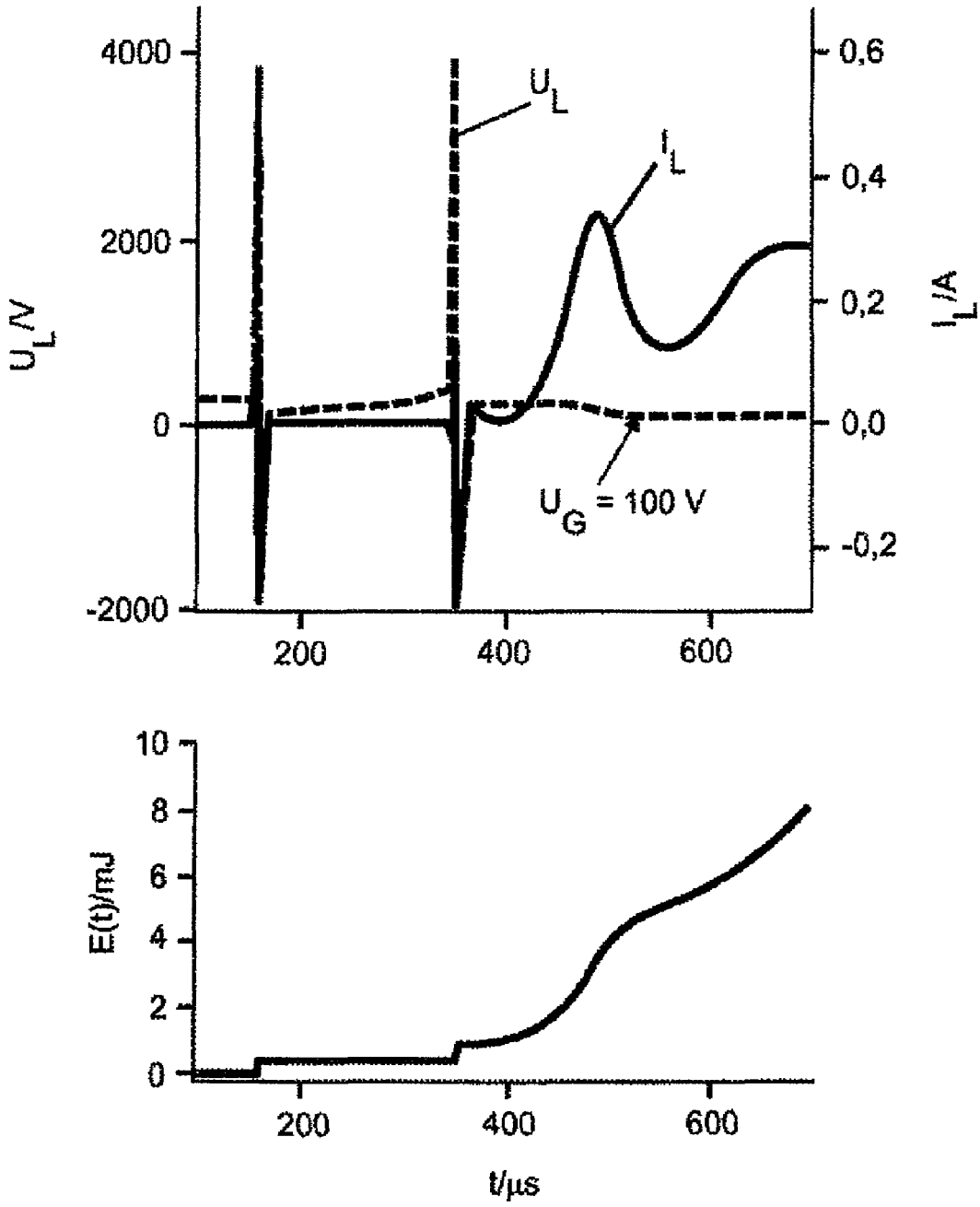
FIG. 2*a* shows the voltage and current and the evaluated power and energy of a high voltage pulse for igniting a discharge lamp, with a lower time resolution.
Figure 2B:
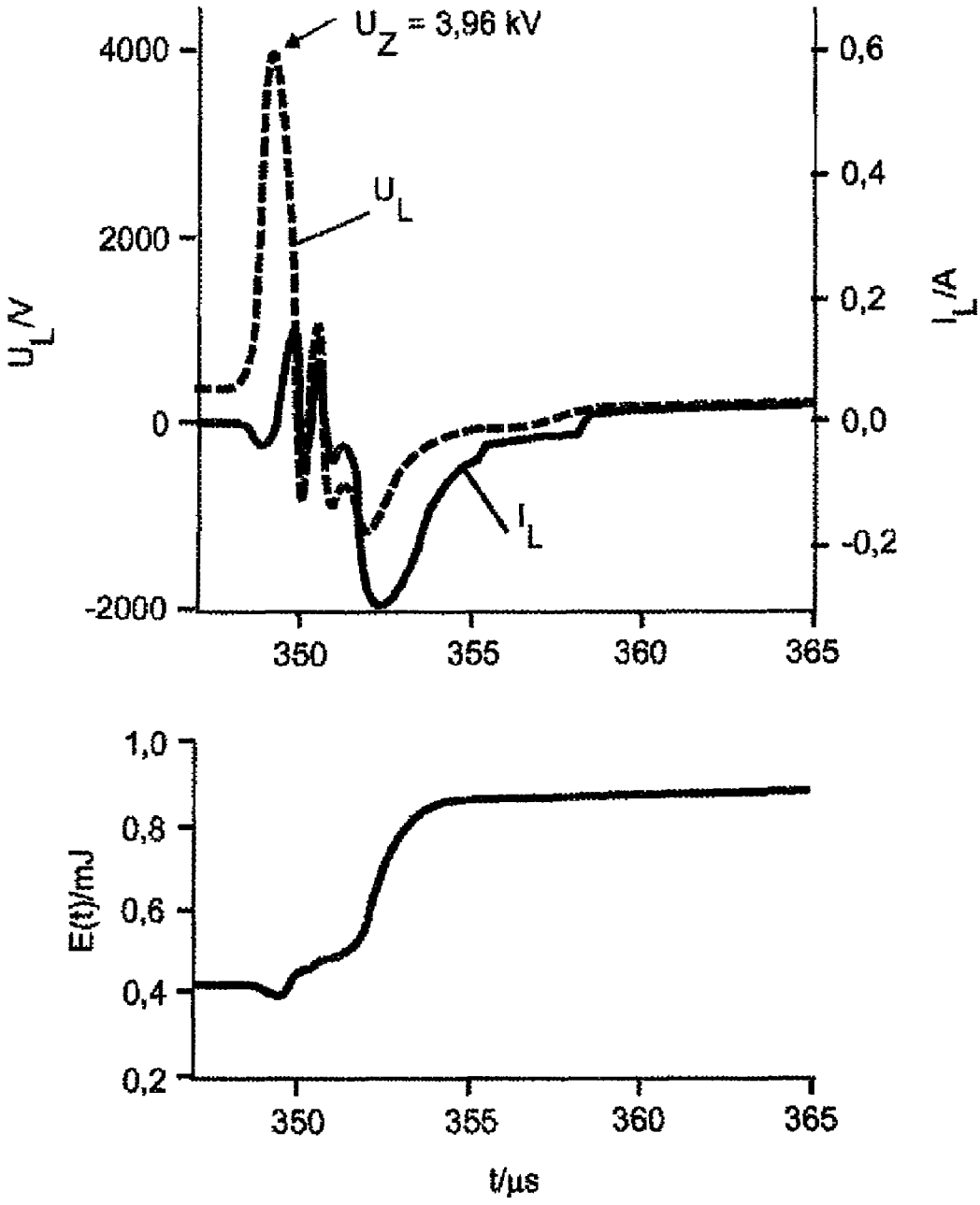
FIG. 2*b* shows the voltage and current and the evaluated power and energy of a high voltage pulse for igniting a discharge lamp, with a higher time resolution, illustrated in a specific region.
Figure 3:
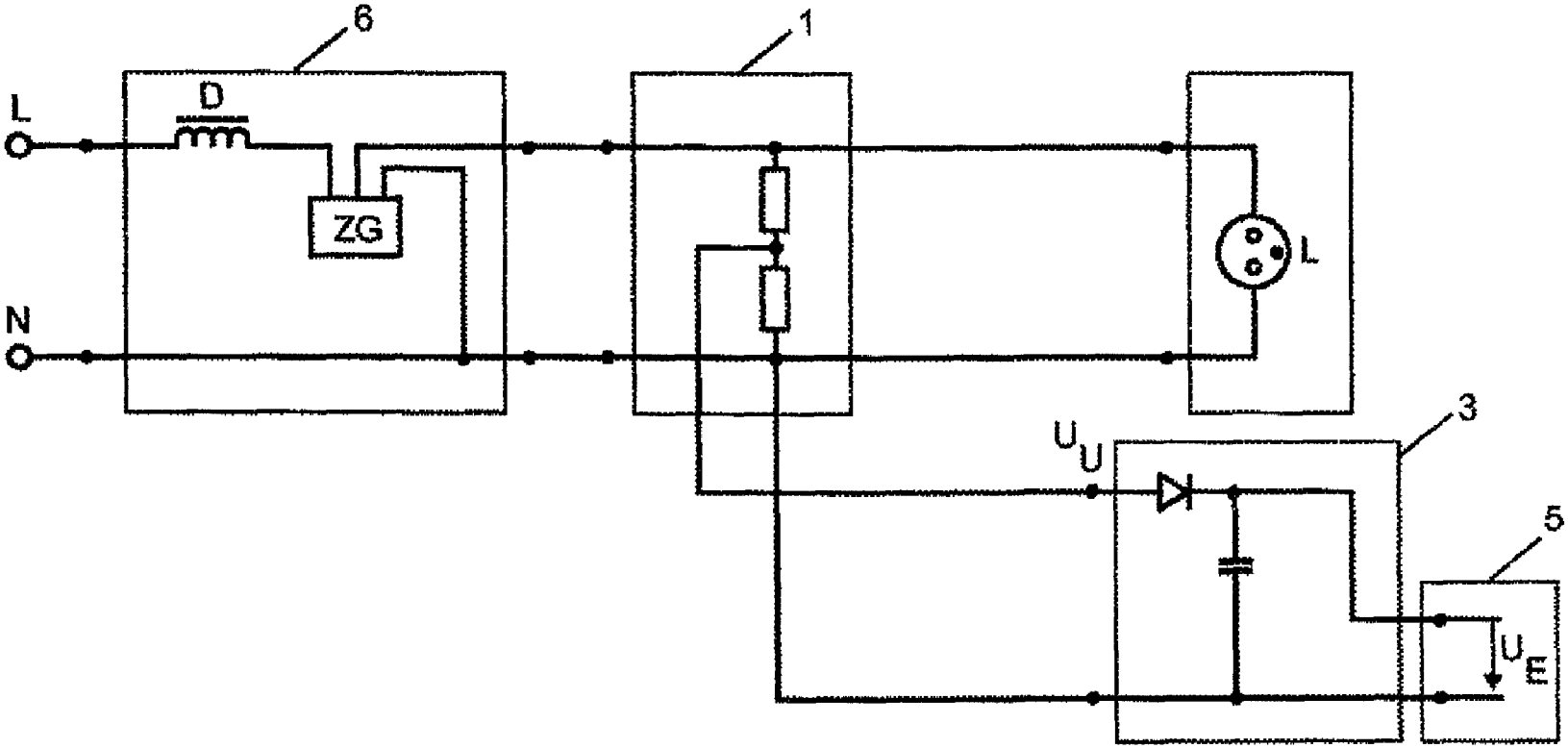
FIG. 3 shows a design for evaluating the positive peak voltage in the case of the ignition of a discharge lamp.
Figure 4:
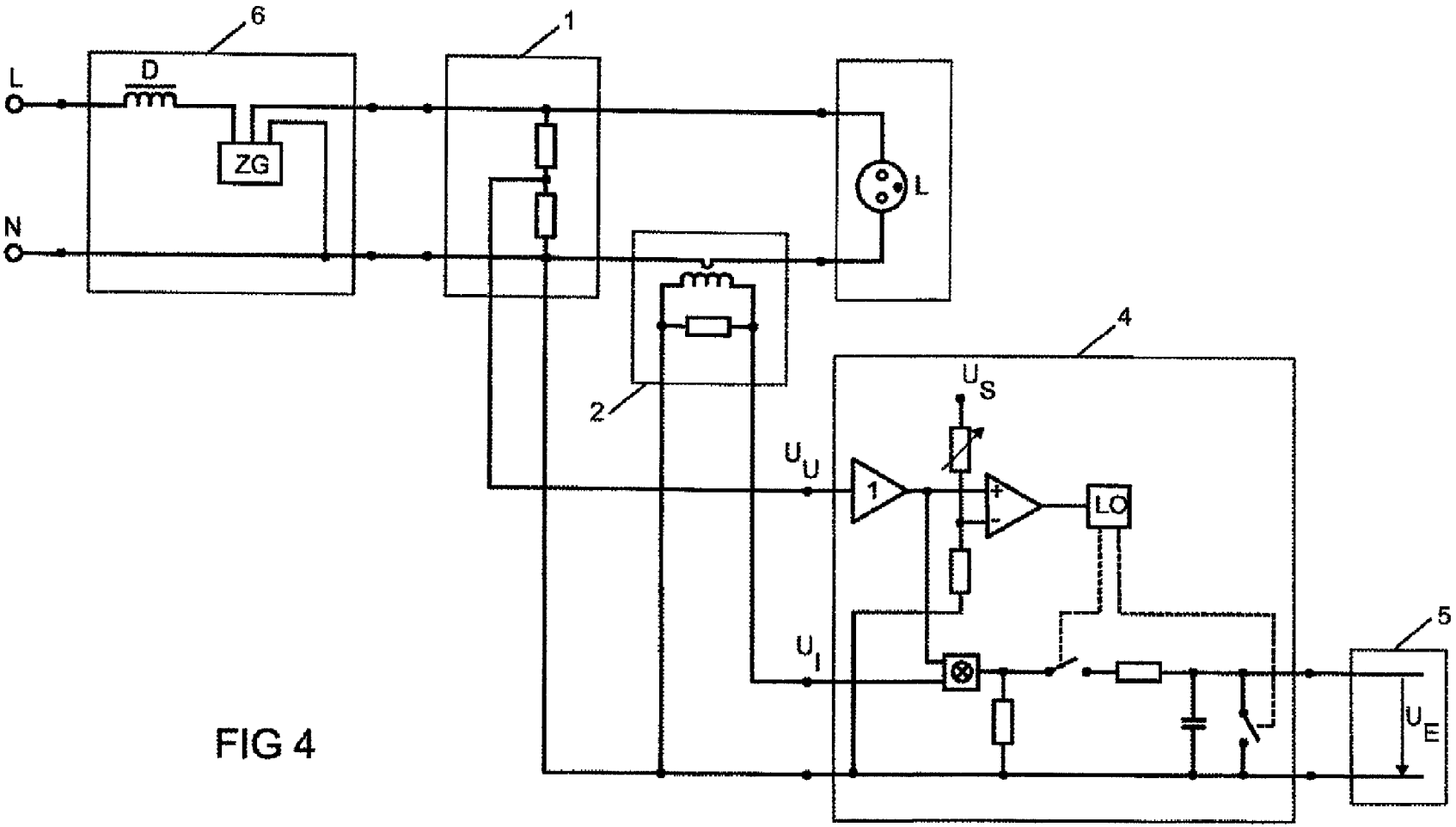
FIG. 4. shows a design for measuring the ignition energy of a discharge lamp.

FIG. 4 shows the inventive design of the evaluation device. The line voltage is connected to the discharge lamp via an inductor (D) and an ignition unit (ZG). A signal voltage $U_U$ is generated with the aid of a suitable voltage divider (1). A signal $U_I$ proportional to the current flowing through the lamp is generated with the aid of a suitable current-to-voltage converter (2) which is preferably looped into the returning cable.

The voltage signal $U_U$ and the current signal $U_I$ are connected to the energy evaluation device (4) in common with a power supply unit $U_S$. The voltage signal is connected to an amplifier that drives the input of the threshold value detector and the multiplier with a sufficient bandwidth. The threshold value detector or comparator supplies a signal when the applied voltage overshoots a certain threshold value. The threshold value can be set by a settable resistor. The threshold value detector passes the state to a logic module.

In addition to the amplified voltage signal $U_U$, the current signal $U_I$ is connected to the input of the multiplier. The output is connected to a load resistor and, via a fast switch and a resistor, to an integration capacitor. After the voltage has overshot a threshold value, the logic module switches the fast switch on and switches it off again after a fixed time. In this time, the applied power signal is integrated, as a result of which a signal $U_{EZ}$ proportional to the ignition energy is present at the integration capacitor. This signal can be measured by a voltmeter. Since, as a rule, ignition units generate a sequence of pulses having pulse intervals, it is necessary in order to measure the energies of the individual pulses to use a measurement system that has a sufficiently high acquisition rate. In addition, the integration capacitor must also be reset, and this can be implemented by a short circuit switch. This switch can obtain its drive signal from the logic module or from the measurement acquisition system. To this end, at a fixed time after the voltage has overshot the threshold value the logic module passes a signal with a short time period to this short circuit switch.

This device operates independently and can be designed as a separately operating system. It is likewise possible for this evaluation device to be integrated in an ignition unit or in an electronic ballast. These applications require the times of the logic module to be adapted to the requirements.

The invention claimed:

1. An evaluation device for measuring an ignition energy of a discharge lamp that is ignited by means of a superposed ignition unit, with the aid of a measuring signal that is proportional to a voltage across the discharge lamp, and a measuring signal that is proportional to a current flowing through the discharge tamp, wherein the evaluation device is configured such that the energy injected into the discharge lamp during a high voltage pulse is suitably evaluated by means of a combination of an analog circuit and a digital circuit, and further comprising a circuit arrangement configured to evaluate a power signal derived at least in part from the voltage and current measuring signals and to integrate the power signal.

2. The evaluation device as claimed in claim 1, further comprising a first switch between the circuit arrangement configured to evaluate the power signal and the circuit arrangement configured to integrate the power signal.

3. The evaluation device as claimed in claim 2, further comprising a second switch at the output of the circuit arrangement configured to integrate the power signal in order to reset said circuit arrangement configured to integrate the power signal.

4. The evaluation device as claimed in claim 3, further comprising a logic module that is connected to the evaluation device to detect the high voltage pulse and is connected to the first switch and to the second switch.

5. The evaluation device as claimed in claim 4, wherein the logic module is configured to switch on the first switch immediately after detection of the high voltage pulse and to switch it off again after a fixed time.

6. The evaluation device as claimed in claim 4, wherein the logic module is configured to close the second switch after a fixed time after the opening of the first switch.

7. The evaluation device as claimed in claim 1, further comprising a measurement acquisition system, wherein the measurement acquisition system is configured to measure the values of the voltage applied to the discharge lamp in time sequence.

8. The evaluation device as claimed in claim 1, configured to be used for igniting a high pressure discharge lamp.

9. An evaluation device for measuring an ignition energy of a discharge lamp that is ignited by means of a superposed ignition unit, with the aid of a measuring signal that is proportional to a voltage across the discharge lamp, and a measuring signal that is proportional to a current flowing through the discharge tamp, wherein the evaluation device is configured such that the energy injected into the discharge lamp during a high voltage pulse is suitably evaluated by means of a combination of an analog circuit and a digital circuit, and further comprising a device configured to detect an application of the high voltage pulse.

10. An evaluation device for measuring an ignition energy of a discharge lamp that is ignited by means of a superposed ignition unit, with the aid of a measuring signal that is proportional to a voltage across the discharge lamp, and a measuring signal that is proportional to a current flowing through the discharge tamp, wherein the evaluation device is configured such that the energy injected into the discharge lamp during a high voltage pulse is suitably evaluated by means of a combination of an analog circuit and a digital circuit, and further comprising a comparator that is connected to the voltage signal measuring signal that is proportional to the voltage and is configured to output a signal starting from a settable threshold voltage.

11. An evaluation device for measuring an ignition energy of a discharge lamp that is ignited by means of a superposed ignition unit, with the aid of a measuring signal that is proportional to a voltage across the discharge lamp, and a measuring signal that is proportional to a current flowing through the discharge tamp, wherein the evaluation device is configured such that the energy injected into the discharge lamp during a high voltage pulse is suitably evaluated by means of a combination of an analog circuit and a digital circuit, and a peak voltage detector whose signals are measured by a measurement acquisition system is used in parallel with said evaluation device.

* * * * *